US007273387B2

(12) United States Patent
Shimirak

(10) Patent No.: US 7,273,387 B2
(45) Date of Patent: Sep. 25, 2007

(54) ELECTRICAL CONNECTOR

(75) Inventor: Gerald L. Shimirak, Winchester, CA (US)

(73) Assignee: Channell Commercial Corporation, Temecula, CA (US)

( * ) Notice: Subject to any disclaimer, the term of this patent is extended or adjusted under 35 U.S.C. 154(b) by 0 days.

(21) Appl. No.: 11/357,882

(22) Filed: Feb. 16, 2006

(65) Prior Publication Data

US 2006/0160406 A1 Jul. 20, 2006

Related U.S. Application Data

(63) Continuation of application No. 10/799,338, filed on Mar. 12, 2004, now Pat. No. 7,018,230.

(51) Int. Cl.
*H01R 4/24* (2006.01)

(52) U.S. Cl. ..... 439/417

(58) Field of Classification Search ..... 439/417, 439/389, 540.01, 412–413, 708–709
See application file for complete search history.

(56) References Cited

U.S. PATENT DOCUMENTS

| | | | |
|---|---|---|---|
| 4,431,241 | A | 2/1984 | Hazelhurst |
| 4,639,820 | A | 1/1987 | Dolansky et al. |
| 5,112,245 | A | 5/1992 | Shimirak et al. |
| 5,399,100 | A | 3/1995 | Dooley et al. |
| 5,515,436 | A | 5/1996 | Bonvallat |
| 6,015,312 | A | 1/2000 | Escane |
| 6,077,112 | A | 6/2000 | Daoud et al. |
| 6,099,343 | A | 8/2000 | Bonvallat et al. |
| 6,123,566 | A | 9/2000 | Daoud et al. |
| 6,193,556 | B1 | 2/2001 | Escane |
| 6,196,862 | B1 | 3/2001 | Dooley |
| 6,247,959 | B1 | 6/2001 | Daoud et al. |

(Continued)

FOREIGN PATENT DOCUMENTS

DE 28 14 018 10/1979

(Continued)

OTHER PUBLICATIONS

Discrete IDS Connectors, Channel, Section 8, pp. 8-1 through 8-2.

(Continued)

*Primary Examiner*—J. F. Duverne
(74) *Attorney, Agent, or Firm*—Buchanan Ingersoll & Rooney

(57) ABSTRACT

The electrical connector assembly includes a first pair of contact members, each comprising a first termination end and a first connection end. A second pair of contact members, each comprising a second termination end and a second connection end, wherein the first connection end and the second connection end are in contact. A connector having a pair of wire receiving passages movable between a first position in which a pair of wires are held apart from the second termination end and a second position in which the pair of wires are inserted into the second termination end. The connector is capable of removing the pair of wires from the second termination end and reinserting the pair of wires into the second termination end. A surge arrester can be provided to protect the connector from over-voltage or over-current to the system.

21 Claims, 10 Drawing Sheets

U.S. PATENT DOCUMENTS

| | | | | |
|---|---|---|---|---|
| 6,283,785 | B1 | 9/2001 | Daoud | |
| 6,296,515 | B1 | 10/2001 | Daoud | |
| 6,302,723 | B1 | 10/2001 | Baum et al. | |
| 6,350,158 | B1 * | 2/2002 | Arnett et al. | 439/676 |
| 6,457,990 | B1 | 10/2002 | Daoud | |
| 6,572,399 | B2 | 6/2003 | Shimirak | |
| 7,110,534 | B1 * | 9/2006 | Mullaney et al. | 379/428.01 |

FOREIGN PATENT DOCUMENTS

| | | |
|---|---|---|
| EP | 0 690 523 | 1/1996 |
| FR | 2 771 219 | 5/1999 |
| GB | 2 102 635 | 2/1983 |
| GB | 2 129 630 | 5/1984 |
| GB | 2 176 062 | 12/1986 |
| GB | 2 260 036 | 9/1991 |
| GB | 2 261 773 | 5/1993 |
| GB | 2 287 367 | 9/1995 |
| GB | 2 293 699 | 4/1996 |
| GB | 2 296 393 | 6/1996 |
| GB | 2 303 500 | 2/1997 |
| GB | 2 320 144 | 6/1998 |
| GB | 2 329 287 | 3/1999 |
| WO | WO96/24960 | 8/1996 |
| WO | WO 02/11249 | 2/2002 |

OTHER PUBLICATIONS

3M Scotchlok, UR2, UY2, and UB2A Connectors, 2 pgs.
3M Scotchlok Connectors and Tools Instructions, Jul. 1994, Issue 2, 80-6107-4684-6, 6 pgs.
Scotchlok 211 Trim-Out Connector, Instruction Bulletin, Issue 2, Nov. 1987, 2 pgs.
3M Scotchlok 211 Trim-Out Connector, 1996, 2 pgs.

* cited by examiner

ELECTRICAL CONNECTOR

CROSS REFERENCE TO RELATED APPLICATIONS

This application is a continuation of U.S. patent application Ser. No. 10/799,338, filed Mar. 12, 2004 now U.S. Pat. No. 7,018,230, which is incorporated herein in its entirety.

The present invention relates to electrical connectors, in particular electrical connectors for use in telecommunication systems.

BACKGROUND

The typical telephone communications system includes a large number of telephone wires coming from the telephone company, termed distribution wires, which can either be in the form of multi-wire buried cable or aerial cable. These wires must be connected to particular wires extending to telephones at particular sites. Terminal blocks are typically used to connect the large number of multiple wire pairs. Such terminal blocks typically connect from 1 to 50 individual service wire pairs to the distribution cable that may have several thousand-wire pairs. Generally, the terminal block is spliced to the distribution cable through a splicing cable or stub cable that forms part of the terminal block. The customer service wires are then connected to the terminal blocks through some type of terminal, which, ideally, enables the service wires to be easily connected, tested, disconnected and reconnected on site.

As new telephones are installed in a locality, an end or each phone wire is coupled or terminated to an appropriate terminal on the terminal block. Where insulated wires are to be terminated in the field, the conductors of the insulated wires need to be easily installed or affixed to the terminal. As many wires are required for operation, it is essential that the installation of the wires be accomplished with minimal effort and tooling. Generally, such terminal blocks include stub cables previously affixed thereto with discrete wires joined at one end to respective terminals in the block and the terminations sealed such as by potting. The terminated ends of the discrete wires of the stub cable are then spliced in the field to the appropriate ones of the distribution wires outside of the terminal block in a spliced closure.

Insulated wires within the industry are not always the same gauge and therefore the connectors and terminals must be designed to accommodate more than one wire size. A typical size wire, running from the terminal block to the phone installation can be a copper-clad steel wire with a gauge of about 18½ AWG (F-drop wire), or a solid copper wire having a gauge of about 19 to 26 AWG having a considerable thinner insulation jacket than the 18½ AWG gauge wire. It can be appreciated, that a connector having a higher quality means for terminating conductors, and having a means to accommodate more than one insulated wire size is desirable.

One type of connector used for in-line splicing of telecommunication wires is the discrete connector. The discrete connector is primarily used for in-line or ½ tap slicing (or bridge splicing) of telecommunication wire pairs. The discrete connector typically includes a pair of insulation displacement connectors (IDC), which are encased in a plastic housing. The discrete connection is typically a one-time use connector, which provides no protection against power surges cause by lightning or other electrical surges. In addition, the discrete connector often does not include any means for testing the electrical circuit from either the central office or to the customer.

Accordingly, it would be desirable to have an electrical connector assembly that is easily installed and provides reusability, a means to test the connection from the central office and to the customer, and which also provides lightening and surge protection.

SUMMARY

In accordance with one embodiment, an electrical connector assembly comprising; a first pair of contact members, each comprising a first termination end and a first connection end; a second pair of contact members, each comprising a second termination end and a second connection end, wherein the first connection end and the second connection end are in contact; and a connector comprising a pair of wire receiving passages movable between a first position in which a pair of wires are held apart from the second termination end and a second position in which the pair of wires are inserted into the second termination end, wherein the connector is capable of removing the pair of wires from the second termination end and reinserting the pair of wires into the second termination end.

In accordance with an alternative embodiment, an electrical connector assembly comprising: a first pair of contact members, each comprising a first termination end and a first connection end, a surge arrester positioned between the first pair of contact members; a second pair of contact members, each comprising a second termination end and a second connection end, wherein the first connection end and the second connection end are in contact; and a connector comprising a pair of wire receiving passages movable between a first position in which a pair of wires are held apart from the second termination end and a second position in which the pair of wires are inserted into the second termination end, wherein the connector is capable of removing the pair of wires from the second termination end and reinserting the pair of wires into the second termination end.

In accordance with another embodiment, an electrical connector comprising: a pair of contact members, each comprising a first insulation displacement connector at a first end and a second insulation displacement connector at a second end, wherein the first and second insulation displacement connectors are configured to enable two wire pairs to be linked; a surge arrester positioned between the pair of contact members; and a grounding member connected to the surge arrester.

In accordance with an alternative embodiment, an electrical terminal for linking two wire pairs, comprising: a housing, the housing comprising a base member and at least two movable covers adapted to receive two wire pairs; and a connector, the connector comprising: a pair of contact members comprising a first end and a second end, each end comprising an insulation displacement connectors configured to enable two wire pairs to be linked; a surge arrester positioned between the contact members; and a grounding member connected to the surge arrester.

In accordance with another embodiment, an electrical terminal for linking two wire pairs, comprising: at least two contact members, each contact member bent to have a first end and a second end, each end comprising a self stripping slot formed therein configured to receive a wire having an insulation protective coating; a surge arrester positioned between the contact members; and a grounding member connected to the surge arrester.

In accordance with a further embodiment, a method of connecting two wire pairs comprising: providing an electrical connector assembly comprising: a first pair of contact members, each comprising a first termination end and a first connection end; a second pair of contact members, each comprising a second termination end and a second connection end, wherein the first connection end and the second connection end are in contact; a connector comprising a pair of wire receiving passages movable between a first position in which a pair of wires are held apart from the second termination end and a second position in which the pair of wires are inserted into the second termination end, wherein the connector is capable of removing the pair of wires from the second termination end and reinserting the pair of wires into the second termination end; and a base member adapted to receive the first pair of contact members and the second pair of contact members, and a cap member, the cap member adapted to urge a pair of wires into the first termination end; inserting a first two wire pair into a first pair of openings in the cap member and positioning an end of the first two wire pair in a vicinity of the first termination end; closing the cap member onto the base member to urge the first wire pair into the first termination end; inserting a second two wire pair into the wire receiving passage of the connector; and moving the connector form the first position in which the second pair of wires are held apart from the second termination end to the second position in which the second pair of wires are inserted into the second termination end.

In accordance with another embodiment, an electrical connector assembly comprising: a first pair of contact members, each comprising a first termination end and a first connection end; a second pair of contact members, each comprising a second termination end and a second connection end; a pair of surge arrester contact members, wherein the first connection end is connected to a first end of the surge arrester contact member and the second connection end is connected to a second end of the surge arrester contact member; a surge arrester positioned between the pair of surge arrester contact members; and a grounding member connected to the surge arrester.

In accordance with a further embodiment, an electrical connector comprising: at least two contact members, each contact member bent to have a first end and a second end; wherein the second end comprises a self stripping slot formed therein configured to receive a wire having an insulation protective coating; a first connector comprising a pair of wire receiving passages movable between a first position in which a pair of wires are held apart from the first end and a second position in which the pair of wires are inserted into the first end, wherein the connector is capable of removing the pair of wires from the first end and reinserting the pair of wires into the first end; a surge arrester positioned between the contact members; and a grounding member connected to the surge arrester.

DETAILED DESCRIPTION

Figure 1:
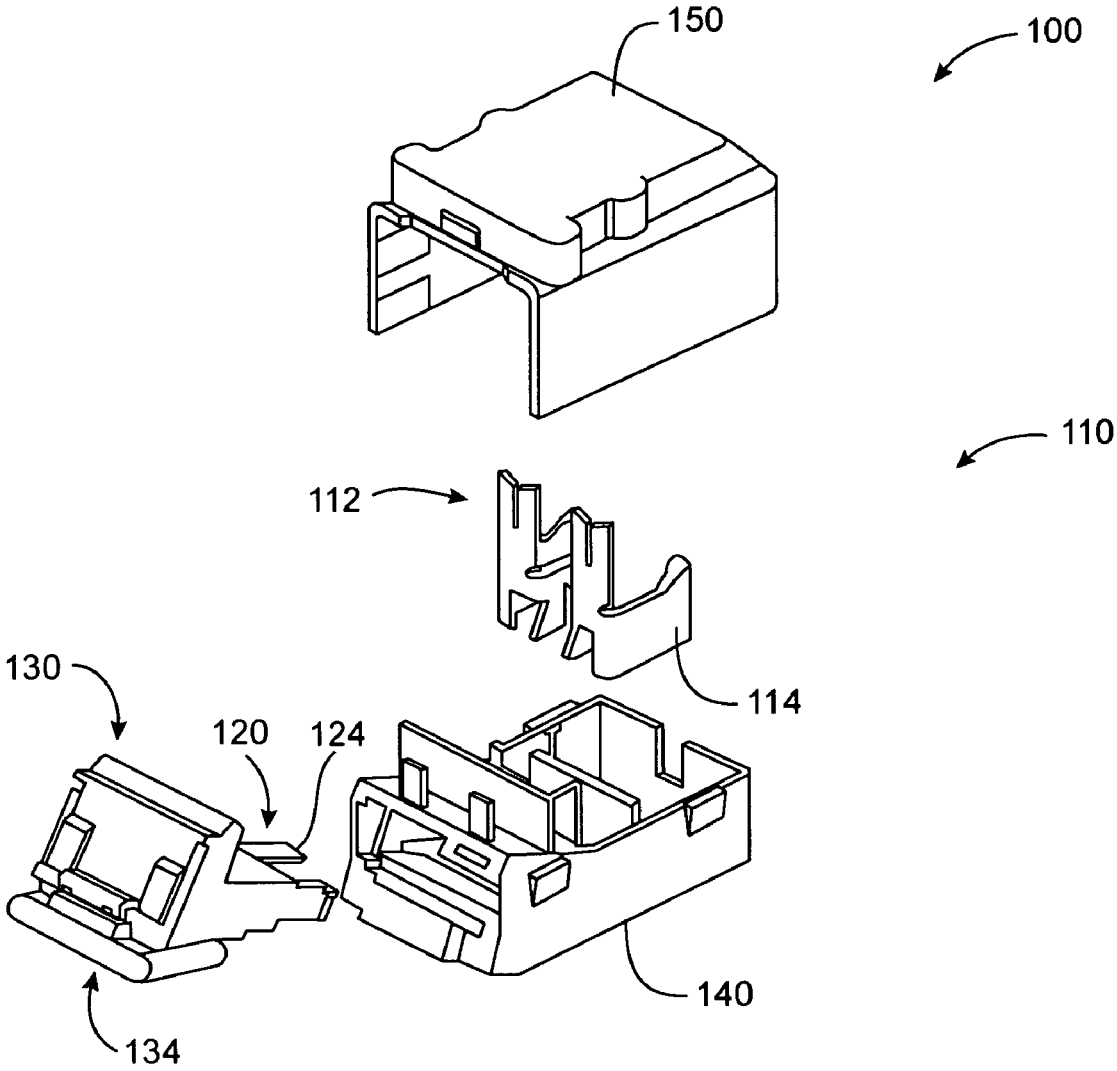
FIG. 1 shows an exploded perspective view of an electrical connector assembly according to one embodiment.

FIG. 1 shows an exploded perspective view of an electrical connector assembly 100 according to one embodiment. The electrical connector assembly 100 includes a first pair of contact members 110, a second pair of contact members 120, and connector 130 having a pair of wire receiving passages 136.

As shown in FIG. 1, the first pair of contact members 110 each has a first termination end 112 and a first connection end 114. The first termination end 112 can be an insulation displacement connector (IDC) configured to receive an insulated wire or any other suitable connector adapted to receive an insulated wire. The termination end 112 preferably pierces the insulation of the insulated wire, removing the insulation from the wire. The first connection end 114 is configured to electrically connect the first pair of contact members 110 to the second pair of contact members 120.

The second pair of contact members 120 each has a second termination end 122 and a second connection end 124. The first termination end 122 also can be an insulation displacement connector (IDC) or other suitable connector adapted to receive an insulated wire.

Figure 2A:
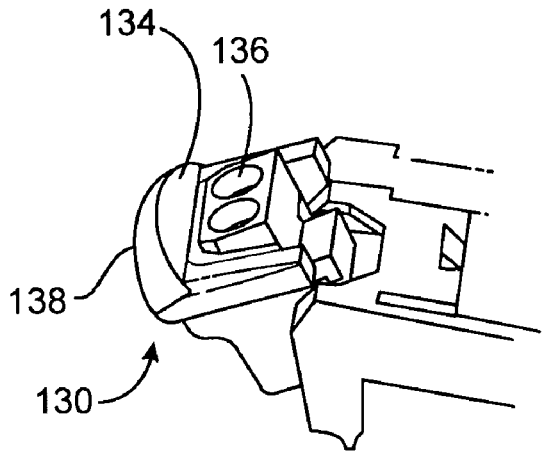
FIG. 2A shows a perspective view of a connector in a first position in which a pair of wires is held apart from the termination end.
Figure 2B:
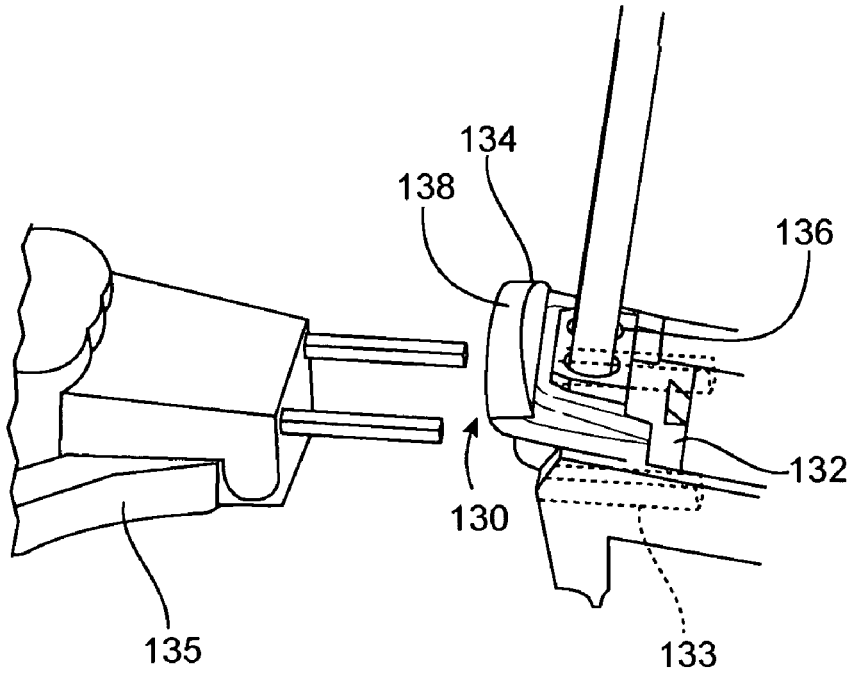
FIG. 2B shows a perspective view of a connector in a second position in which a pair of wires is inserted into the termination end.

As shown in FIGS. 2A and 2B, the assembly 100 also includes a connector 130 having a pair of wire receiving passages 136 movable between a first position in which a pair of wires are held apart from the second termination end 124 and a second position in which the pair of wires are inserted into the second termination end 124. FIG. 2A shows a perspective view of a connector in a first position in which a pair of wires is held apart from the second termination end 124. FIG. 2B shows a perspective view of a connector in a second position in which a pair of wires is inserted into the second termination end 124.

The first termination end 114 and the second termination end 124 generally will accept wires having a gauge of about 26 AWG to about 18½ AWG (about 0.4 to 0.9 mm). The outer diameter of the wires including insulation can be up to about 2.06 mm for standard telephone wires. However, it can be appreciated that the assembly 100 can be designed to accommodate wires having other gauges including Category 3, 5, and 6 broadband wires. In addition, the assembly 100 is designed to accommodate wires of different gauges. For example, in one embodiment, the first termination end 114 can accept a pair of wires having an 18½ AWG gauge (F drop wire), while the second termination end 24 can accept a pair of wires having a 24 AWG gauge (Standard telephone wire).

The connector 130 includes a body member 132 and a receptacle 134. The receptacle 134 including the pair of wire receiving passages 136. The wire receiving passages 136 being movable between the first position in which the wires are held apart from the second termination end 124 and the second position in which the wires are inserted into the second termination end 124. The receptacle 134 can include a handle 138 adapted to move the wire receiving passages 136 to either the first or the second position. The connector 130 is capable of removing the pair of wires from the second termination end 124 and reinserting the pair of wires into the second termination end 124.

Provided within the body member 132 of the connector 130 is the second pair of contact members 120. The second contact members 120 are preferably IDC connectors, positioned such that movement of the housing to the second position causes an inserted wire to be engaged by the IDC connector. In addition, movement of the receptacle 134 back to the first position disengages the wire from the IDC connector. For example, the connector 130 can be a mini-rocker switch as manufactured and sold by Channel Communications, Temecula, Calif., which allows the connector assembly 100 to be a multiple use assembly, rather than a single use assembly.

In operation; a pair of wires is inserted into the wire receiving passages 136 in the first position where the wires are held apart from the second termination ends 124. The technician grasps the handle 138 of the receptacle 134 and pushes the handle forward causing the wire receiving passages 136 and receptacle 134 to move to the second position. In the second position, the IDC connector engages the pair of wires. If the technician desires to remove the pair of wires from engagement with the IDC connector, the handle 138 of the receptacle 134 is pushed downward releasing the ends of the wires from engagement with the IDC connector. The pair of wires is then removed from the wire receiving passages 136. If re-entry is desired, the ends of the wire are preferably cut at a distance of about 10 mm and the wires are then re-inserted into the wire receiving passages 136. Alternatively, a second pair of wire can be re-inserted into the wire receiving passages 136 and pushing forward the handle 138 to engage the second pair of wires with the IDC connector.

In addition, the connector 130 includes a test port 133 configured to receive a test clip 135. The test clip 135 allows the technician to test the electrical connector assembly 100 for electrical signals from the central office ("C.O.") and for service to the customer. If the technician wants to test only the central office line, the connector 130 is placed in the first position in which the wires are held apart from the second termination end 124 and the test clip 135 is inserted into the test port 133. Alternatively, if the technician wants to test both the central office line and the outgoing service line to the customer, the connector 130 can be placed in the second position in which the wire are engaged with the IDC connector and the test clip 135 inserted into the test port 133.

The assembly 100 can also include a base member 140 adapted to receive the first pair of contact members 110 and the second pair of contact members 120, and a cap member 150. Preferably, the base member 140 includes a first receiving slot 142 adapted to receive the first pair of contact members 110 and a second receiving slot 144 adapted to receive the second pair of contact members 120. The first receiving slot 142 and the second receiving slot 144 are arranged such that the first and second pairs of contact members 110, 120 are electrically connected.

The electrical connector 100 also includes a cap member 150. The cap member 150 is configured to overlie the first contact member 110 and the second contact member 120. The cap member 150 can include at least two openings 152 configured to receive a pair of wires. The cap member 150 is configured to urge a portion of a wire onto the first termination ends 112. In operation, a pair of wires is inserted through the at least two opening 152 into the electrical connector 100. The pair of wires is positioned in the connector such that when cap member 150 is engaged with the base member 140, the cap member 150 urges the pair of wires onto the termination ends 112. Preferably, the termination ends 112 are insulation displacement connectors, which remove the insulation from the pair of wires.

The cap member 150 can be a snap fit or otherwise engagable with the remainder of the housing by any suitable means for connecting the cap member 150 to the base member 140.

The base member 140 can also include at least one retaining structure configure to retain a wire in the electrical connector assembly 100. The at least one retaining structure provides a pre-crimping feature which prevents the wire pairs from slipping out of assembly 100 before the cap member 150 has been crimped or engaged with the base member 140.

The electrical connector assembly 100 can also include a factory-installed sealant for insulating against corrosion and sealing out moisture. The factory-installed sealant can be a high viscosity-sealing compound that ensures protection of the connections, excellent installation resistance, and good electrical performance even in extreme environmental conditions. Alternatively, the assembly 100 can be unfilled for internal plant applications or other desired situations where a sealant is not desired.

Figure 3:
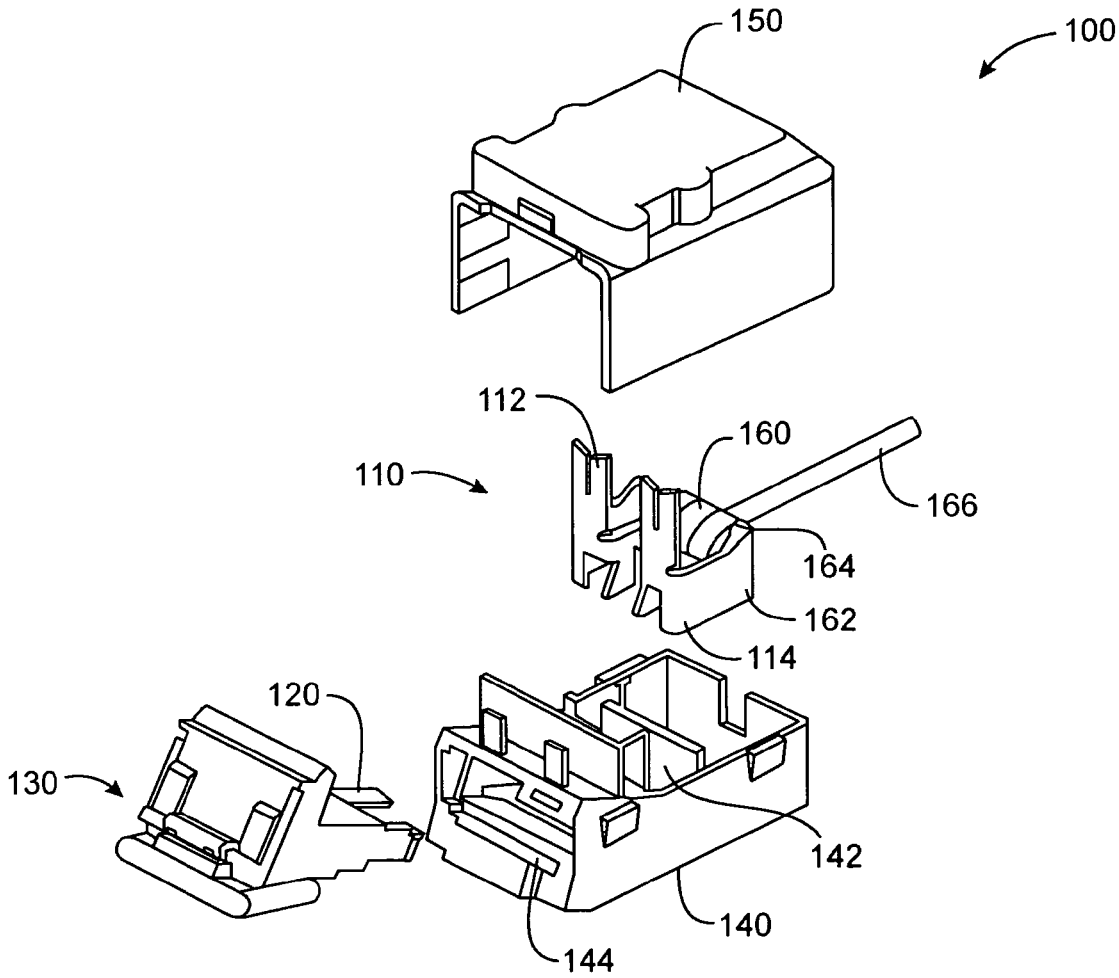
FIG. 3 shows another exploded perspective view of an electrical connector assembly according to another embodiment.

FIG. 3 shows an alternative embodiment of the electrical connector of FIG. 1. As shown in FIG. 3, the electrical connector assembly 100 includes a first pair of contact members 110, a second pair of contact members 120, and a connector 130 having a pair of wire receiving passages 136, and a surge arrester 160. The surge arrester 160 is positioned between the first pair of contact members 110. The surge arrester 160 protects the electrical connector from over-voltage, or over-current to the system. The surge arrester 160 can act as a primary surge protector, wherein the surge arrester 160 is configured to receive the initial voltage or current surge. Alternatively, the surge arrester 160 can be a secondary surge protector, wherein the surge arrester 160 receives the voltage or current surge after the voltage or current surge has been dissipated through a primary surge protector.

As shown in FIG. 3, the first pair of contact members 110 can further includes a pair of arrester contacts 164 spaced so as to receive the surge arrester 160. In this embodiment, the surge arrester 160 is positioned between the pair of arrester contacts 164. The surge arrester 160 provides for overload protection for the electrical connector assembly 100.

In one embodiment, a grounding member 166, such as a wire, a bar, a strap, a barrel or tubular connector or other suitable metallic or polymeric conductive element, is attached to the surge arrester 160. The surge arrester 160 can be a metal oxide varistor (MOV), a gas discharge arrester or gas tube, a fuse, a toroidal choke coil, diode, solid state, clamp, poly switch or any other suitable surge protector or surge suppressor.

In addition, the arrester contacts 164 are preferably welded to the surge arrester 160, however, it can be appreciated that any type of contact means including spring contacts can be used.

Figure 4:
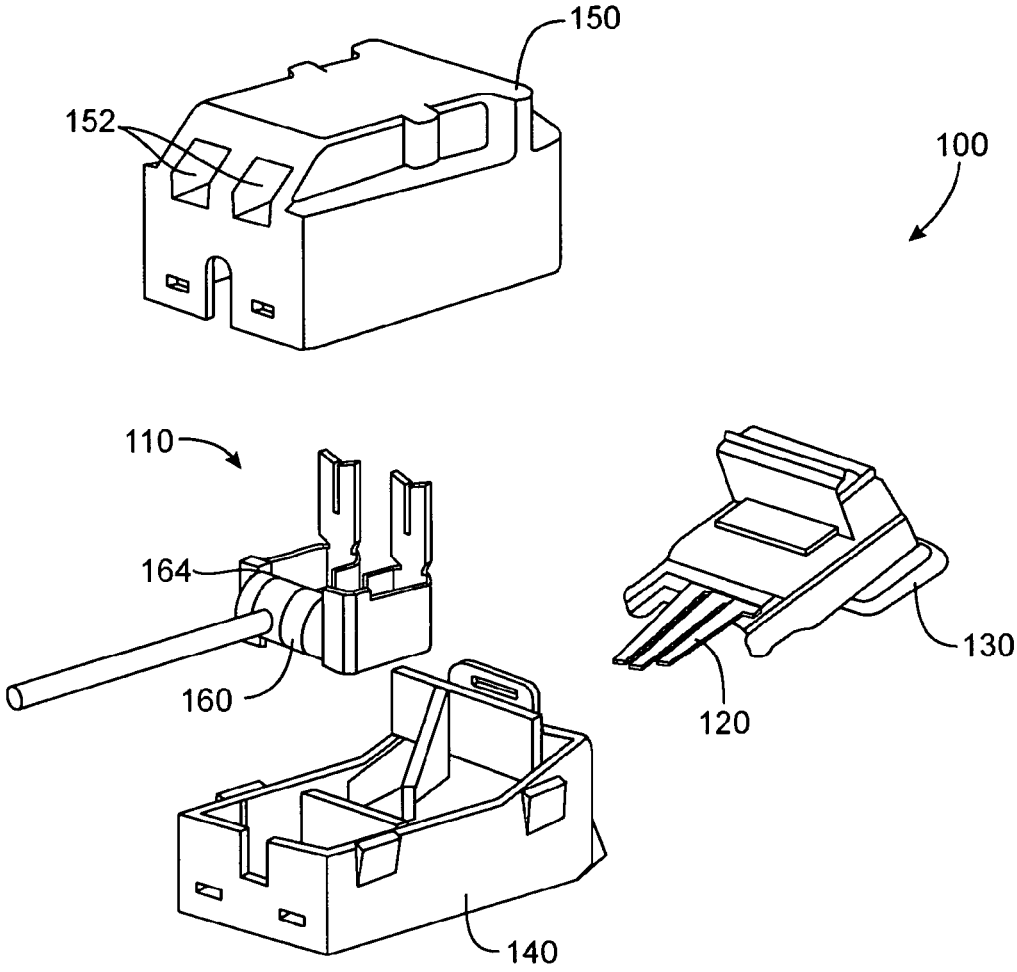
FIG. 4 shows an exploded perspective view of the electrical connector assembly of FIG. 3.

FIG. 4 shows another exploded perspective view of the electrical connector 100 having the surge arrester 160 positioned between a pair of arrester contacts 164. As shown in FIG. 4, the grounding member 166 is affixed to the surge arrester 160 for added overload protection in over-load or over-current situations.

Figure 5:
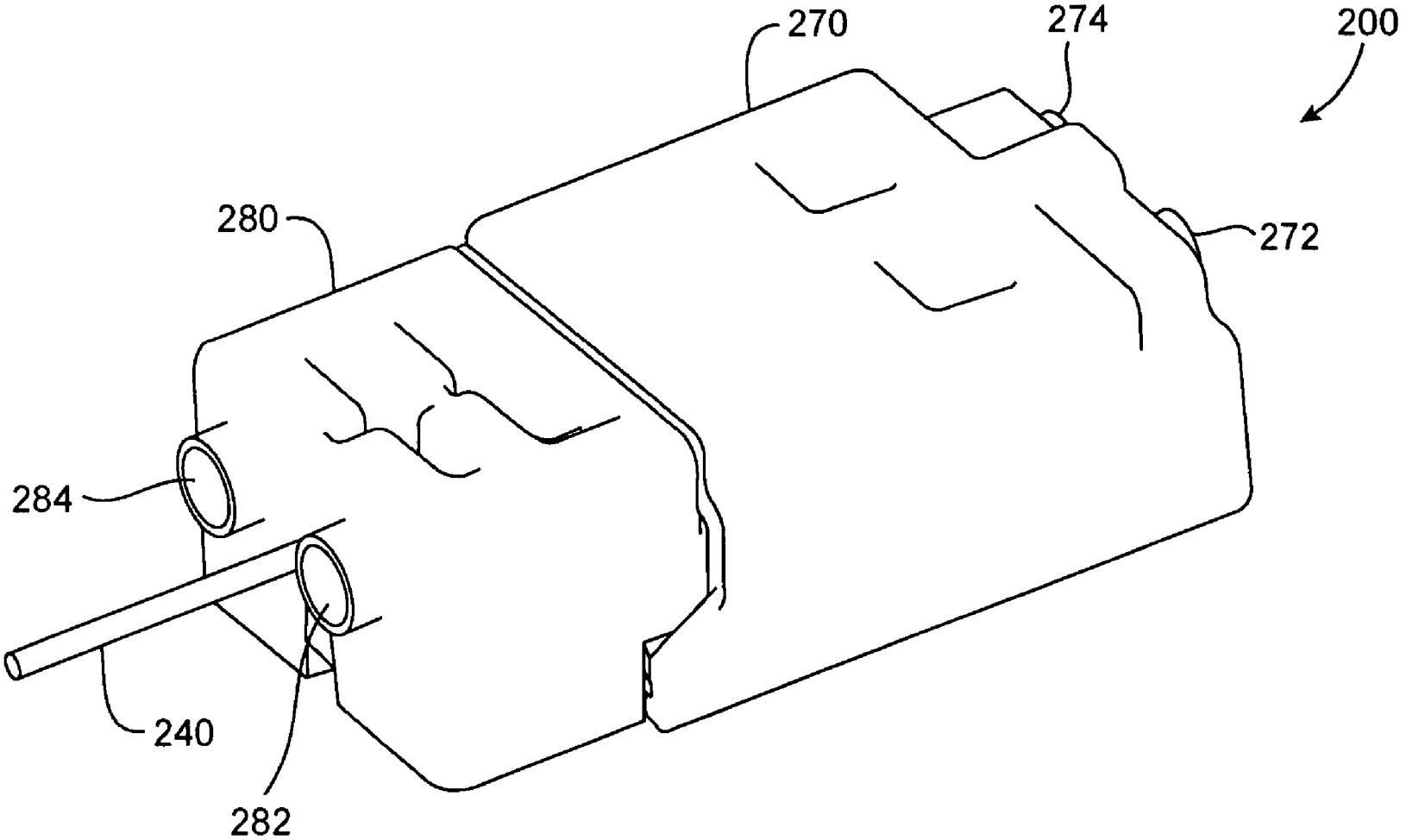
FIG. 5 shows a perspective view of an electrical connector according to an alternative embodiment.
Figure 6:
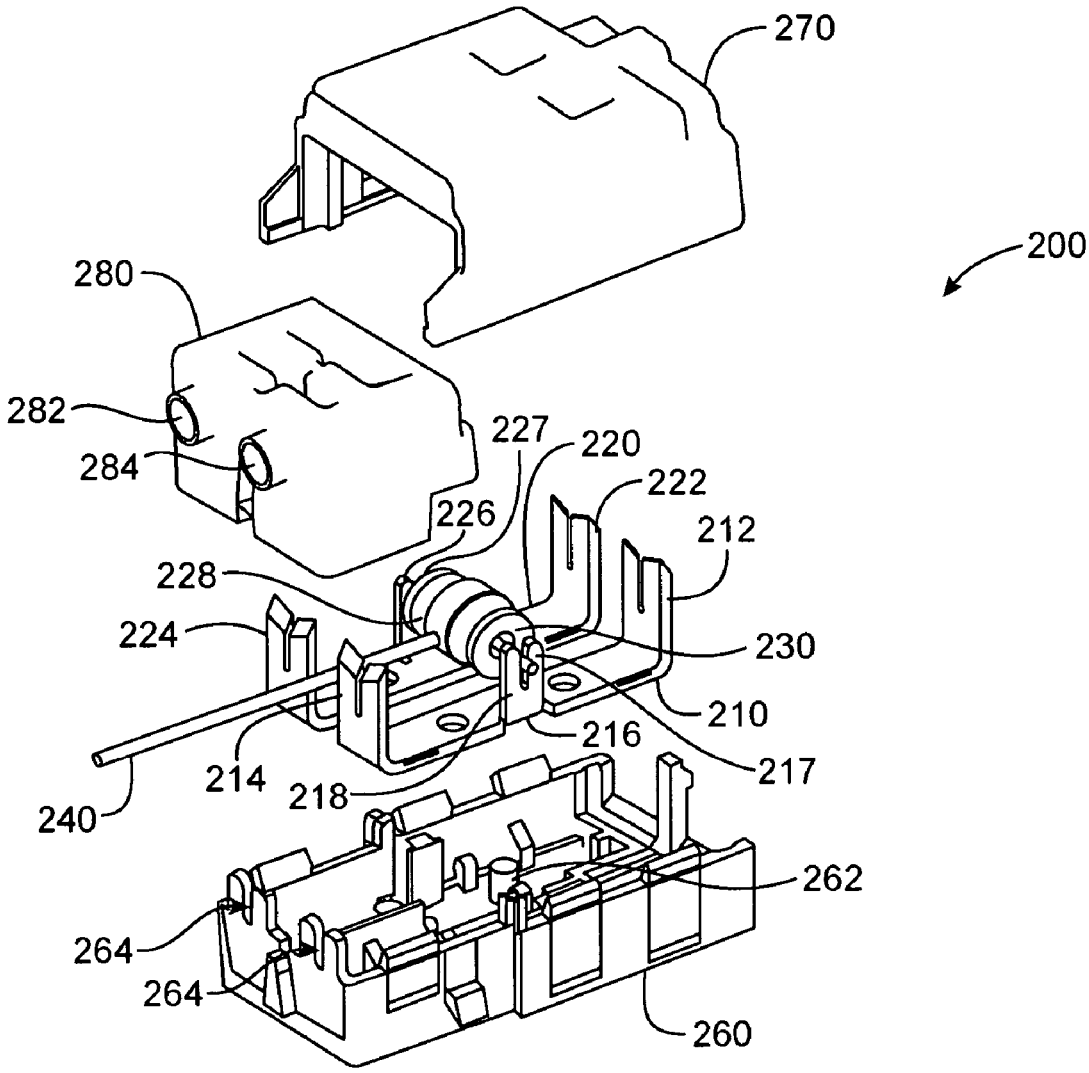
FIG. 6 shows an exploded perspective view of the electrical connector of FIG. 5.

FIGS. 5 and 6 show another embodiment of an electrical connector 200. As shown in FIGS. 5 and 6, the electrical connector 200 includes a pair of contact members 210, 220, a surge arrester 230, and a grounding member 240 connected to the surge arrester 230.

The contact members 210, 220, each have a self-stripping slot formed therein in the form of a first insulation displacement connector at a first end 212, 222 and a second insulation displacement connector at a second end 214, 224. The first and second insulation displacement connectors 212, 214, 222, and 224 are configured to enable two wire pairs to be linked. Each contact member 210, 220 includes the first and second ends 212, 214, 222, 224, and a main body member 211, 221. The contact members 210, 220 also include a pair of contact arms 216, 226 attached to the main body member 211, 221 of each of the contact members 210, 220. The surge arrester 230 is positioned between the contact arms 216, 226. In a preferred embodiment, each contact member 210, 220 is bent to form the first and second ends 212, 214, 222, 224.

The insulation displacement connectors 212, 214, 222, and 214 can extend in a direction substantially transverse to the main body member 211, 221 of the contact member 210, 220. The two contact arms 216, 226 also extend in a direction substantially transverse to the main body member 211, 221 of the contact members 210, 220 leading to a pair of arrester contacts 218, 228.

The arrester contacts 218, 228 are preferably spring contacts, thereby to enable replacement of the surge arrester 230. However, if desirable the surge arrester 230 can be welded to the contact arm 216, 226, provided in a slot 217, 227 as shown in FIG. 6 or affixed in any other suitable manner. In one embodiment, the contact arms 216, 226 and the contact members 210, 220 are not manufactured from a single piece of conductive material, but instead are joined together by welding or other means. By providing the contact arms 216, 226 as a separate piece and extending the contact arms 216, 226 from the edge of the main body members 211, 221 of the contact members 210, 220, this provides a particularly simple but effective electrical contact. In addition, this also avoids the need to bend a single-piece blank, thereby risking damage to or distribution of the IDC connector.

The surge arrester 230 is positioned between the pair of surge arrester contacts 218, 228. In one embodiment, a grounding member 240 can be connected to the surge arrester 230 to provide added surge protection to the electrical connector 200. The grounding member 240 can be a wire, a bar, a strap, a barrel or tubular connector or other suitable metallic or polymeric conductive element.

As shown in FIGS. 5 and 6, the electrical connector 200 further includes a housing 250 to protect the contact members 210, 220 from outside elements including rain and snow. The housing includes a base 260, a first cap 270 and a second cap 280. The first cap 270 and the second cap 280 operate independent of each other and can be crimped or closed in any order or simultaneous. Thus, in operation, a pair of wires is inserted through a recess 282, 284 in the first cap 270 or second cap 280, which is then crimped to urge the insulated pair of wires onto the insulation displacement connectors of the contact members 210, 220.

The base 260 can also include a plurality of spindles 262 adapted to receive the contact members 210, 220. It can be appreciated the any means of securing the contact members 210, 220 in the base 260 can be used. The base 260 can also include at least one retaining structure 264 for retaining a wire in the electrical connector 200. The at least one retaining structure 264 provides a pre-crimping feature which prevents the wire pairs from slipping out of connector 200 before the first cap 270 or second cap 280 has been crimped.

In one embodiment, the insulation displacement connectors at the first end 212, 222 are adapted to receive a wire of about 18.5 to about 26 AWG. In addition, the insulation displacement connectors at the second end 214, 224 are configured to receive a wire of about 16 to about 19 AWG. Typically, the AWG wire is a plastic, paper or pulp insulated solid copper wire. However, the connector 200 can accept other suitable electrical conductors.

The first cap 270 has at least two openings (not shown) configured to receive a pair of wires. The second cap 280 has at least openings 282, 284 configured to receive a second pair of wires. The first cap 270 and the second cap 280 are configured to urge a portion of a wire onto the insulation displacement connectors 212, 214, 222, and 224.

As shown in FIGS. 5 and 6, the electrical connector 200 further includes a housing 250 to protect the contact members 210, 220 from outside elements including rain and snow. The housing 250 includes a base 260, a first cap 270 and a second cap 280. The first cap 270 and the second cap 280 operate independent of each other and can be crimped or closed in any order or simultaneous. Thus, in operation, a pair of wires is inserted through the openings 282, 284 in the first cap 270 or second cap 280, which is then crimped to urge the insulated pair of wires onto the insulation displacement connectors of the contact members 210, 220.

Figure 7:
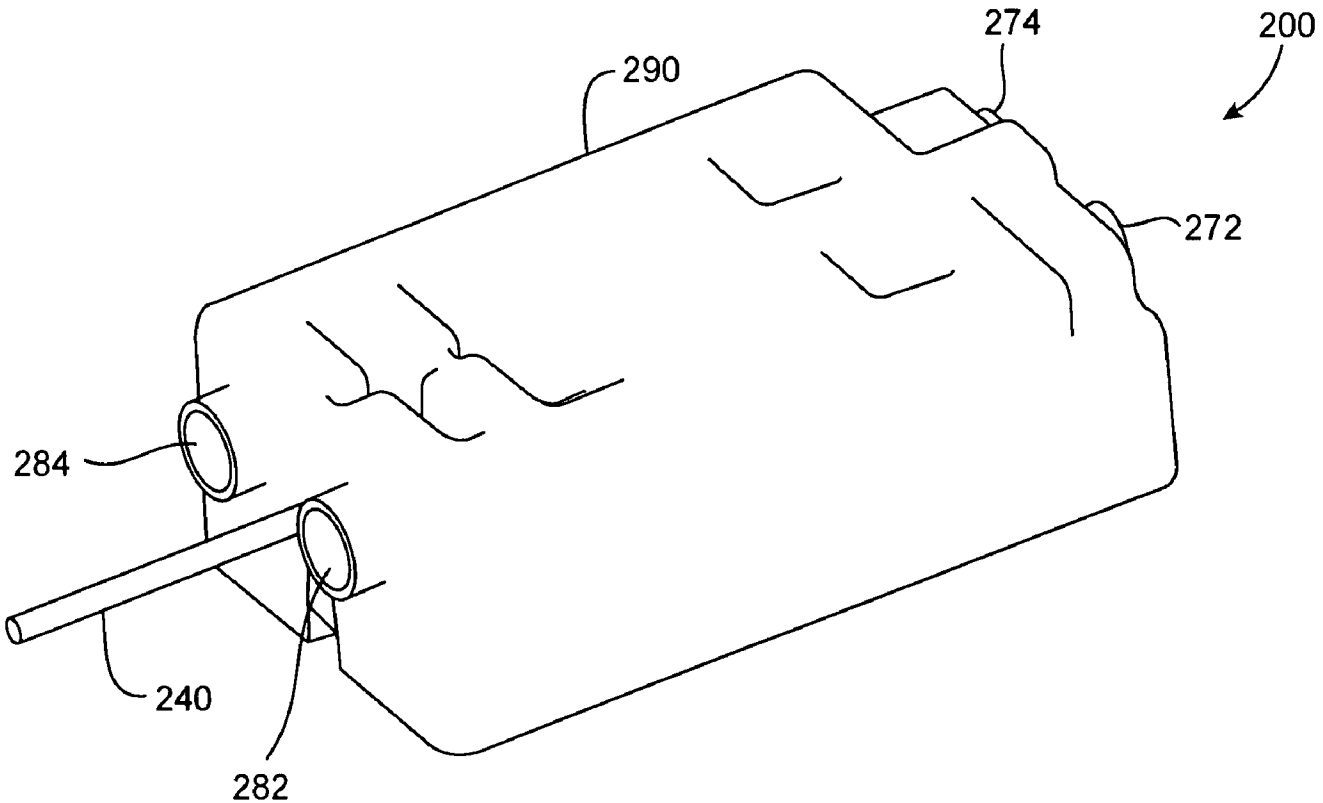
FIG. 7 shows a perspective view of an electrical connector according to a further embodiment.

FIG. 7 is another embodiment of the electrical connector 200 of FIG. 6 having a housing 250 to protect the contact members 210, 220 from outside elements including rain and snow. The housing 250 includes a base 260 and a single cap member 280. In this embodiment, the two pairs of wires are inserted through the openings 272, 274, 282, and 284 into the single cap member 290. The single cap member 290 is then crimped to urge the two insulated pairs of wires onto the insulation displacement connectors of the contact members 210, 220.

Figure 8:
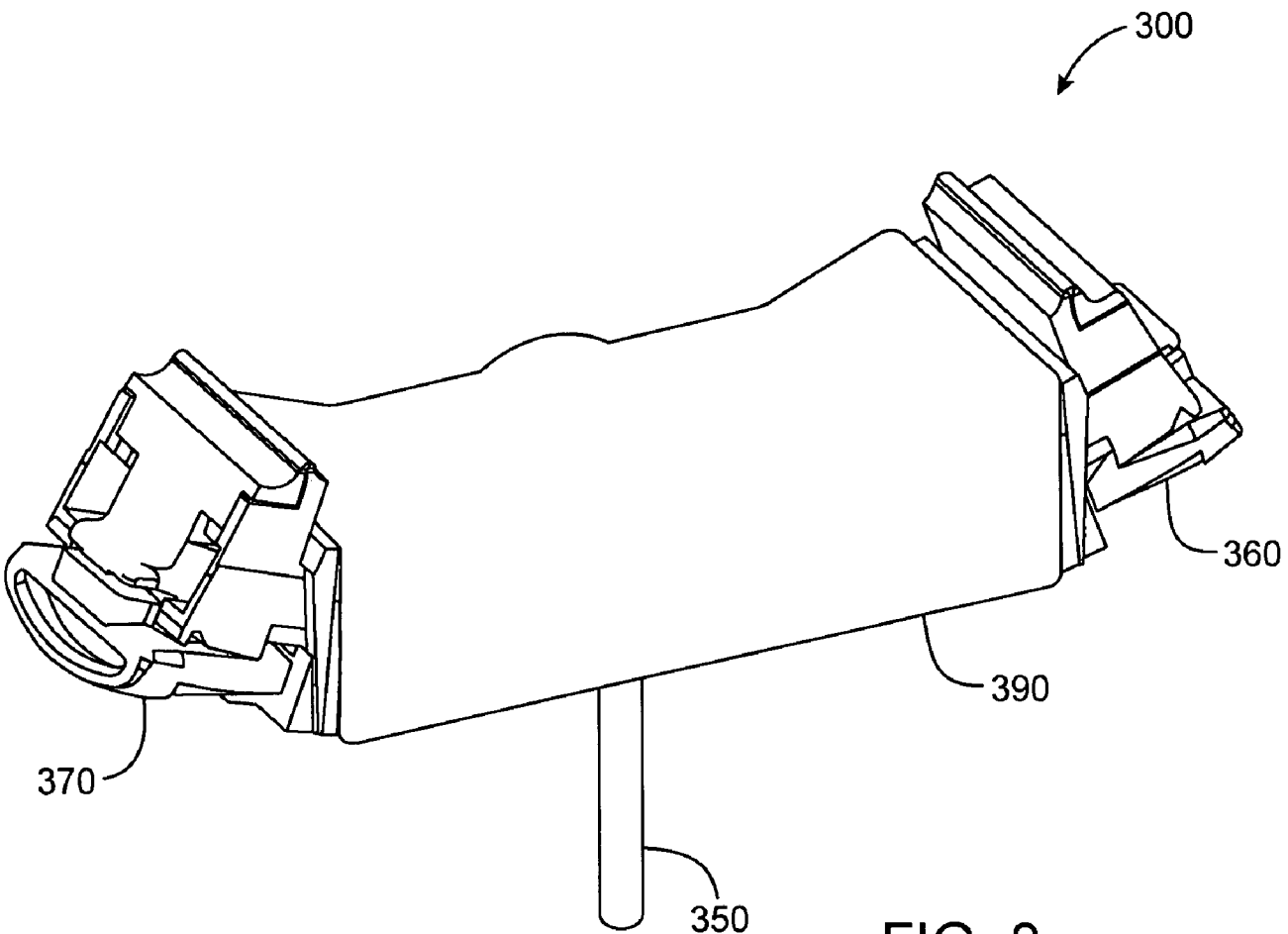
FIG. 8 shows a perspective view of an electrical connector assembly according to another embodiment.
Figure 9:
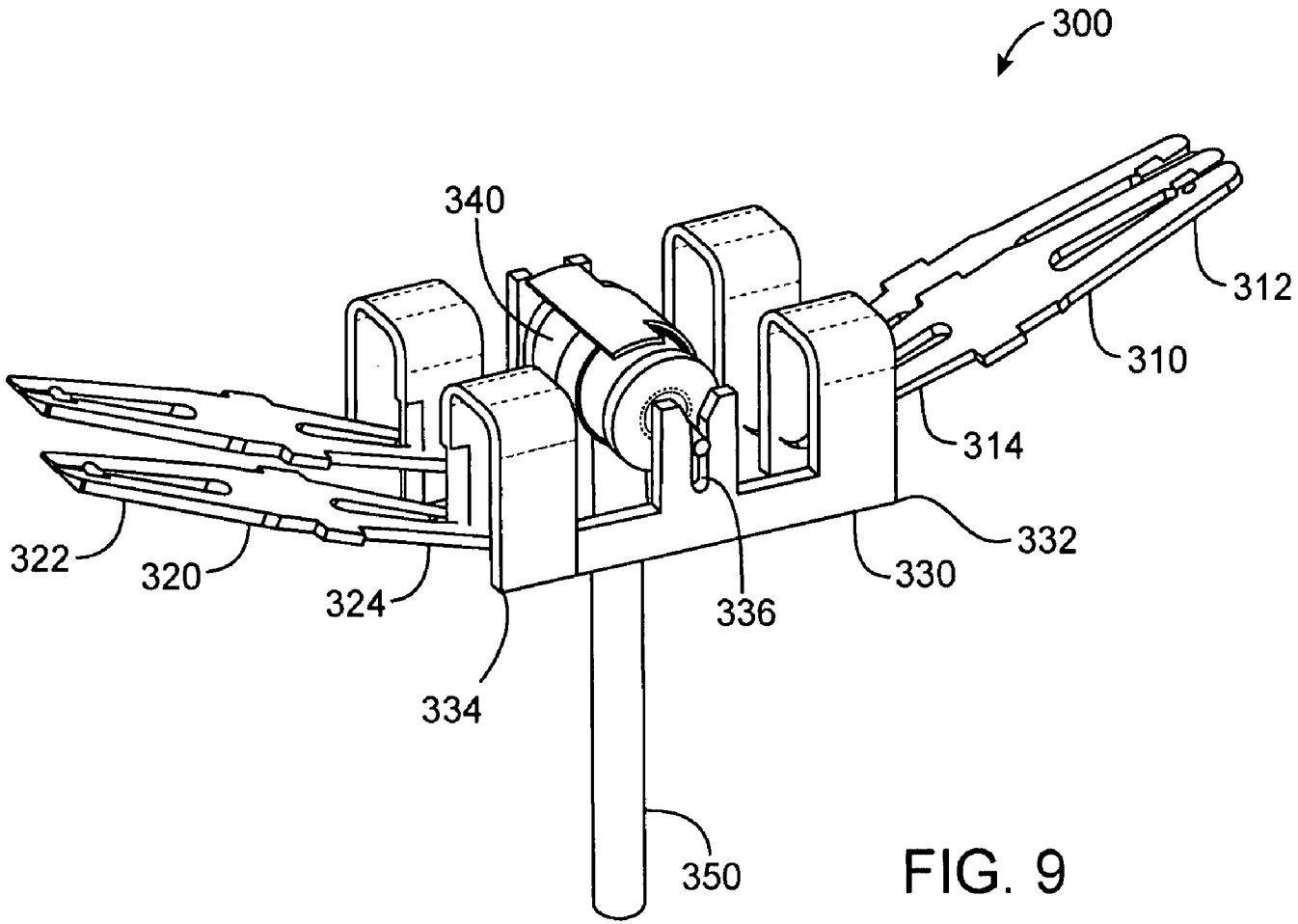
FIG. 9 shows an exploded perspective view of the electrical connector assembly of FIG. 8.

FIG. 8 shows a perspective view of an alternative embodiment of an electrical connector assembly 300. As shown in FIG. 9, the assembly 300 comprises a first pair of contact members 310, a second pair of contact members 320, and a pair of surge arrester contact members 330, a surge arrester 340 and a grounding member 350.

The first pair of contact members 310 each has a first termination end 312 and a first connection end 314. The first termination end 312 can be an insulation displacement connector (IDC) configured to receive an insulated wire or any other suitable connector adapted to receive an insulated wire. The first termination end 312 preferably pierces the insulation of the insulated wire, removing the insulation from the wire. The first connection end 314 is configured to electrically connect the first pair of contact members 310 to the second pair of contact members 320 via the pair of arrester contact members 330.

The second pair of contact members 320 each has a second termination end 322 and a second connection end 324. The first termination end 322 also can be an insulation displacement connector (IDC) or other suitable connector adapted to receive an insulated wire.

Figure 10:
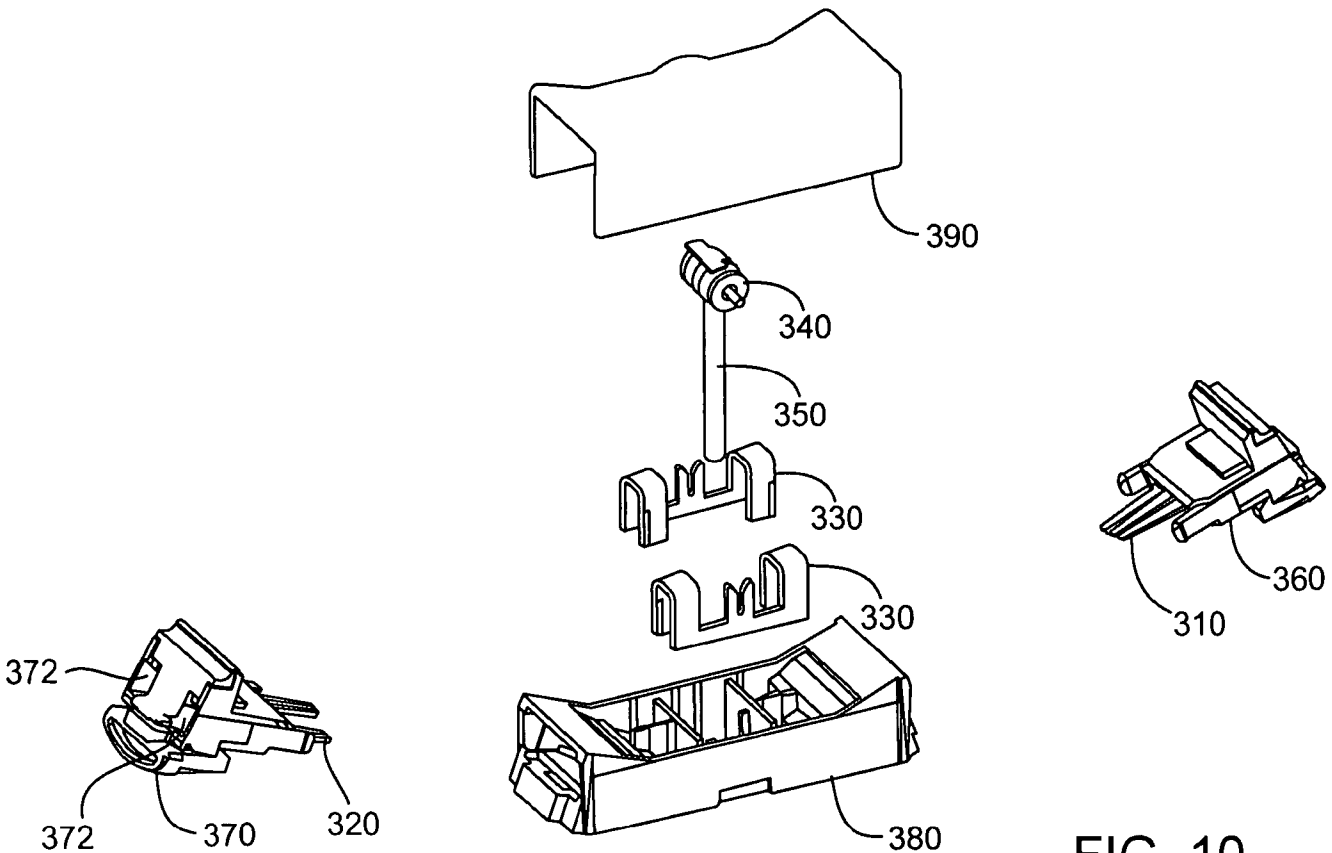
FIG. 10 shows another exploded perspective view of the electrical connector assembly of FIG. 8.

In one embodiment as shown in FIG. 10, the first contact member 310 and the second contact member 320 are encased in a first connector 360, and a second connector 370, respectively. Each connector 360, 370 has a pair of wire receiving passages movable between a first position in which a pair of wires are held apart from the termination end and a second position in which the pair of wires are inserted into the termination end. FIG. 2A shows a perspective view of a connector in a first position in which a pair of wires is held apart from the termination end. FIG. 2B shows a perspective view of a connector in a second position in which a pair of wires is inserted into the termination end. The connectors 360, 370 are capable of removing the pair of wires from the termination end and reinserting the pair of wires into the termination end.

The first termination end 314 and the second termination end 324 generally will accept wires having a gauge of about 26 AWG to about 18½ AWG (about 0.4 to 0.9 mm). The outer diameter of the wires including insulation can be up to about 2.06 mm for standard telephone wires. However, it can be appreciated that the assembly 300 can be designed to accommodate wires having other gauges including Category 3, 5, and 6 broadband wires. In addition, the assembly 300 is designed to accommodate wires of different gauges.

Provided within the body member of the connectors 360, 370 are the pair of contact members 310, 320. The contact members 310, 320 are preferably IDC connectors, positioned such that movement of the housing to the second position causes an inserted wire to be engaged by the IDC connector. In addition, movement of the receptacle back to the first position disengages the wire from the IDC connector. For example, the connector can be a mini-rocker switch as manufactured and sold by Channel Commercial Corporation, Temecula, Calif., which allows the connector assembly to be a multiple use assembly, rather than a single use assembly.

A pair of surge arrester contact members 330 is configured to receive the first and second connection ends 312, 322 of the first pair of contact members 310 and the second pair of contact members 320, respectively. In one embodiment, the first connection end 312 of the first pair of contact members 310 is connected to a first end 342 of the surge arrester contact members 330 and the second connection end 322 is connected to a second end 344 of the surge arrester contact member 330.

A surge arrester 340 is positioned between the pair of surge arrester contact members 330. The surge arrester 340 is positioned between the pair of arrester contact members 330. The surge arrester 340 provides for overload protection for the electrical connector assembly 300. The surge arrester 340 can be a metal oxide varistor (MOV), a gas discharge arrester or gas tube, a fuse, a toroidal choke coil, diode, solid state, clamp, poly switch or any other suitable surge protector or surge suppressor. The surge arrester 340 can be a primary surge protector or a secondary surge protector.

In one embodiment, the arrester contact members 330 have an arrester contact 336 configured to receive the surge arrester 340. The arrester contact 336 can be a self stripping slot such as an IDC type contact as shown in FIGS. 9 and 10, a spring contact or any other suitable contact.

In one embodiment, the grounding member 350 is attached to the surge arrester 340. In addition, the arrester contacts 332 are preferably welded to the surge arrester 340, however, it can be appreciated that any type of contact means including spring contacts can be used. The grounding member 350 can be a wire, a bar, a strap, a barrel or tubular connector or other suitable metallic or polymeric conductive element.

A base member 380 is adapted to receive the first pair of contact members 310, the second pair of contact members 320 and the surge arrester contact members 330, and a cap member 390 provide protection for the contact members 310, 320 from the outside elements including rain or snow, animals and other items that can harm or damage the connection.

Either or both of the connectors 360, 370 can includes a test port 372 (as shown in element 370) configured to receive a test clip. The test clip (as shown in FIGS. 2A and 2B) allows the technician to test the electrical connector assembly 300 for electrical signals from the central office ("C.O.") and for service to the customer. If the technician wants to test only the central office line, the connector 360, 370 is placed in the first position in which the wires are held apart from the first termination end 314 and/or the second termination end 324 and the test clip is inserted into the test ports 372. Alternatively, if the technician wants to test both the central office line and the outgoing service line to the customer, the connectors 360, 370 can be placed in the second position in which the wire are engaged with the IDC connector and the test clip inserted into the test ports 372.

Although the present invention has been described in connection with preferred embodiments thereof, it will be appreciated by those skilled in the art that additions, deletions, modifications, and substitutions not specifically described can be made without departing from the spirit and scope of the invention as defined in the appended claims.

What is claimed is:

1. An electrical connector comprising:

a pair of contact members, each comprising a first insulation displacement connector at a first end and a second insulation displacement connector at a second end, wherein the first and second insulation displacement connectors are configured to enable two wire pairs to be linked;

a first movable connector comprising a pair of wire receiving passages movable between a first position in which a pair of wires is held apart from the first end and a second position in which the pair of wires is inserted into the first end, wherein the connector removes the pair of wires from the first end and inserts the pair of wires into the first end;

a surge arrester positioned between the pair of contact members; and a grounding member connected to the surge arrester.

2. The connector of claim 1, wherein the contact members include a main body member, and wherein the first end and the second end of the contact member extend in a direction substantially transverse to the main body member of the contact member.

3. The connector of claim 1, wherein each contact member includes a contact arm extending in a direction substantially transverse to the main body member.

4. The connector of claim 3, further comprising a pair of surge arrester contacts.

5. The connector of claim 4, wherein the surge arrester is positioned between the pair of surge arrester contacts.

6. The connector of claim 1, further comprising a base member, a first cap and a second cap, wherein the base member is configured to receive the first and second caps.

7. The connector of claim 1, further comprising a base member and a cap member, wherein the base member is configured to receive the cap member.

8. The connector of claim 1, wherein the insulation displacement connectors at the first end and the second end are configured to receive a wire of about 19 to about 26 AWG.

9. The connector of claim 1, wherein the connector includes a factory-installed sealant configured to protect against corrosion and sealing out moisture.

10. The connector of claim 6, wherein the first cap and the second cap are configured to urge a portion of a wire into the insulation displacement connectors.

11. The connector of claim 7, wherein the cap member is configured to urge a portion of a wire into the insulation displacement connectors.

12. The connector of claim 1, wherein the grounding member is a wire.

13. The connector of claim 1, further comprising a second movable connector comprising a pair of wire receiving passages movable between a first position in which a pair of wires is held apart from the second end and a second position in which the pair of wires is inserted into the second end, wherein the connector removes the pair of wires from the second end and inserts the pair of wires into the second end.

14. An electrical connector assembly comprising:

a first pair of contact members, each comprising a first termination end and a first connection end;

a first movable connector comprising a pair of wire receiving passages movable between a first position in which a pair of wires is held apart from the first termination end and a second position in which the pair of wires in inserted into the first termination end, wherein the connector removes the pair of wires from the first termination end and inserts the pair of wires into the first termination end;

a second pair of contact members, each comprising a second termination end and a second connection end;

a pair of surge arrester contact members, wherein the first connection end is connected to a first end of the surge arrester contact member and the second connection end is connected to a second end of the surge arrester contact member;

a surge arrester positioned between the pair of surge arrester contact members; and a grounding member connected to the surge arrester.

15. The assembly of claim 14, wherein each of the surge arrester contact members further includes an arrester contact for positioning the surge arrester between the pair of surge arrester contact members.

16. The assembly of claim 14, further comprising a housing, the housing comprising a base member and a cap member, wherein the base member is configured to receive the first pair of contact members, the second pair of contact members and the surge arrester contact member.

17. The assembly of claim 14, wherein the first and the second termination ends are insulation displacement connectors.

18. The assembly of claim 17, wherein the insulation displacements connectors accept a pair of wires having a gauge of about 19 to about 26 AWG.

19. The assembly of claim 14, wherein the surge arrester is a primary surge protector.

20. The assembly of claim 14, wherein the surge arrester is a secondary surge protector.

21. The assembly of claim 14, further comprising a second movable connector comprising a pair of wire receiving passages movable between a first position in which a pair of wires is held apart from the first termination end and a second position in which the pair of wires is inserted into the second termination end, wherein the connector removes the pair of wires from the second termination end and inserts the pair of wires into the second termination end.

* * * * *